US008555981B2

(12) United States Patent
Edwards et al.

(10) Patent No.: US 8,555,981 B2
(45) Date of Patent: Oct. 15, 2013

(54) RISER WEAK LINK

(76) Inventors: Jeffrey Charles Edwards, Aberdeen (GB); Dewi Graham Rankin, Aberdeenshire (GB)

( * ) Notice: Subject to any disclaimer, the term of this patent is extended or adjusted under 35 U.S.C. 154(b) by 134 days.

(21) Appl. No.: 12/999,700

(22) PCT Filed: Jun. 18, 2009

(86) PCT No.: PCT/GB2009/001535
§ 371 (c)(1),
(2), (4) Date: Feb. 11, 2011

(87) PCT Pub. No.: WO2009/153567
PCT Pub. Date: Dec. 23, 2009

(65) Prior Publication Data

US 2011/0127041 A1 Jun. 2, 2011

(30) Foreign Application Priority Data

Jun. 19, 2008 (GB) ..... 0811219.5

(51) Int. Cl.
*E21B 43/36* (2006.01)
*E21B 17/01* (2006.01)

(52) U.S. Cl.
USPC ..... 166/365; 166/367

(58) Field of Classification Search
USPC ..... 166/338–340, 343–345, 350, 363–365, 166/367
See application file for complete search history.

(56) References Cited

U.S. PATENT DOCUMENTS

| | | | | |
|---|---|---|---|---|
| 3,222,088 | A | 12/1965 | Haeber | |
| 3,889,985 | A * | 6/1975 | Gartmann | 285/95 |
| 4,059,288 | A * | 11/1977 | Mohr | 285/2 |
| 5,382,056 | A * | 1/1995 | Milberger | 285/1 |
| 5,482,119 | A * | 1/1996 | Manke et al. | 166/374 |
| 2004/0173356 | A1 * | 9/2004 | Dore et al. | 166/345 |

FOREIGN PATENT DOCUMENTS

| | | |
|---|---|---|
| GB | 2235229 | 2/1991 |

* cited by examiner

*Primary Examiner* — Matthew Buck
*Assistant Examiner* — James Sayre
(74) *Attorney, Agent, or Firm* — Tarolli, Sundheim, Covell & Tummino LLP

(57) ABSTRACT

A riser weak link (10) is described. The riser weak link comprises an upper housing (16) for connecting to a riser upper section (12), a lower housing (18) for connecting to a riser lower section (14), at least one connection device for releasably connecting the upper and lower housings, and a pressure application device (24) adapted to apply a coupling force to the upper housing to at least partially counter a separation force applied, in use, by well pressure, the well pressure separation force acting to separate the upper and lower housings.

31 Claims, 4 Drawing Sheets

RISER WEAK LINK

CROSS-REFERENCES TO RELATED APPLICATIONS

This application is corresponds to PCT/GB2009/001535, filed Jun. 18, 2009, which claims priority from British Application No. 0811219.5, filed Jun. 19, 2008. The present application claims priority to the aforementioned patent applications, which are incorporated in their entirety herein by reference for all purposes.

FIELD OF THE INVENTION

The present invention relates to an improved riser weak link and particularly, but not exclusively to a pressure balanced weak link.

BACKGROUND TO THE INVENTION

Risers are commonly used to link hydrocarbon wells on the seabed to floating vessels such as oil rigs or ships. A riser is made up of lengths of tubing and is extremely heavy. The surface vessel therefore needs to apply tension to the riser to prevent it collapsing under its own weight. However, in certain sea conditions, for example, as the vessel moves, the applied tension will fluctuate. At excessive tensions, it is known for risers to break. This can cause an environmental catastrophe as, at the time of separation, the riser may be full of hydrocarbons which could subsequently leak from the riser.

To counter this problem, risers may be provided with a weak link which has a lower tensile rating than the other components of the riser and, in the event of over tensioning the riser, the riser will separate at the weak link.

A conventional weak link comprises two parts which are releasably attached to one another by, for example, studs, which fracture at a predetermined tensile force. Such conventional weak link systems, however, have a drawback. The tensile force applied to the weak link is applied not only by the vessel on the surface but also by well pressure. The studs therefore have to be rated to separate at a tension which is a combination of the separation force supplied by well pressure and the tension applied from surface. Well pressure is variable and at high well pressure a conventional weak link can provide very limited operational utilisation and at low pressure a conventional weak link can fail to protect the system.

SUMMARY OF THE INVENTION

According to a first aspect of the present invention there is provided a riser weak link comprising:

- an upper housing for connecting to a riser upper section,
- a lower housing for connecting to a riser lower section,
- at least one connection device for releasably connecting the upper and lower housings, and
- a pressure application device adapted to apply a coupling force to the upper housing to at least partially counter a separation force applied, in use, by well pressure, the well pressure separation force acting to separate the upper and lower housings.

In one embodiment the pressure application device applies a coupling force which counters the separation force applied by well pressure. The effect of this is the net separation force acting on the connection device is primarily the tension in the upper riser section, which is applied by a surface vessel to the upper riser section. As a result the connection device can be more accurately rated to allow separation of the upper housing (including the upper riser section) from the lower housing should the tension in the riser exceed a predetermined value.

The pressure application device may utilise well pressure to apply the coupling force to the upper housing.

Preferably, the pressure application device is adapted to apply a counter force to the upper housing to fully counter the separation force applied, in use, by well pressure. This is achievable by presenting sufficient area of the device to, for example, well pressure to generate a sufficient coupling force between the upper and lower housings.

Preferably, the releasable connection device is adapted to permit the upper and lower housings to separate at a predetermined force.

Preferably, the at least one connection device is at least one stud. The studs transfer the riser tension from the upper to the lower sections.

Alternatively, the at least one connection device is at least one latch, shear ring, hydraulic connector or the like.

Preferably, there are a plurality of studs.

Preferably, the studs are adapted to sever or fracture at a predetermined tension.

Preferably, the pressure application device is moveable between a first position in which the device is latched to the upper housing and a second position in which the device is disengaged from the upper housing.

In the second position the pressure application device may be latched to the lower housing.

In one embodiment, the pressure application device comprises at least one pressure balance piston and at least one latch device.

Preferably, the/each latch device, in the first position, is adapted to engage a latch recess defined by the upper housing.

Preferably, in the first position, the/each pressure balance piston acts on the/each latch device under the influence of the coupling force.

Preferably, the/each pressure balance piston acts in a downward direction on the latch device which in turn transfers the coupling force to the upper housing.

Preferably, the/each pressure balance piston is an annular piston.

Preferably, the/each latch device is a collette or segmented band.

Alternatively, the/each latch device comprises one or more dogs.

Preferably, movement of the upper housing moves the pressure application device from the first position to the second position.

Preferably, the/each latch device, in the second position, is adapted to engage a latch recess defined by the lower housing.

Preferably, the/each pressure balance piston is adapted to encircle a portion of the lower housing.

Preferably, the upper housing is adapted to disconnect completely from the lower housing.

Preferably, when the upper housing is completely disconnected from the lower housing, the/each pressure balance piston is associated with the lower housing.

Preferably, the lower housing defines at least one port for permitting well pressure to access the pressure application device.

Preferably, in the first position the/each port is opened and in the second position the/each port is sealed by the/each pressure balance piston.

Preferably, the upper housing includes a closure device. A closure device is provided to seal the upper housing to, in use, prevent the riser contents being deposited through the upper housing upon separation of the upper housing from the lower housing.

Preferably, the closure device is a flapper. Alternatively, the closure device may be a ball valve, a gate valve or a ram.

Preferably the flapper is biased to seal the throughbore.

Preferably, the riser weak link comprises an override mechanism. An override mechanism is provided to ensure that the upper and lower housings do not separate, for example, when the riser weak link is being run into position.

Preferably, the override mechanism is adapted to retain the pressure application device in the first position.

Preferably, the override mechanism comprises an override piston.

Preferably, the override piston is an annular piston.

Preferably, the override piston is adapted to act directly on the pressure application device and, in one embodiment, directly on the at least one pressure balance piston.

Preferably, the override mechanism is hydraulically controlled. Hydraulic pressure can be readily applied to, for example, the override piston.

According to a second aspect of the present invention there is provided method of pressure balancing a riser weak link, the method comprising the step of:

exposing a pressure application device to a well pressure, the pressure activation device converting the well pressure to a coupling force and applying the coupling force to a riser weak link upper housing, the upper housing being releasably connected to a riser weak link lower housing, the coupling force at least partially countering a separation force applied by well pressure, the well pressure separation force acting to separate the upper and lower housings.

BRIEF DESCRIPTION OF THE DRAWINGS

Embodiments of the present invention will now be described with reference to the accompanying drawings in which.

DETAILED DESCRIPTION OF THE INVENTION

Figure 1:
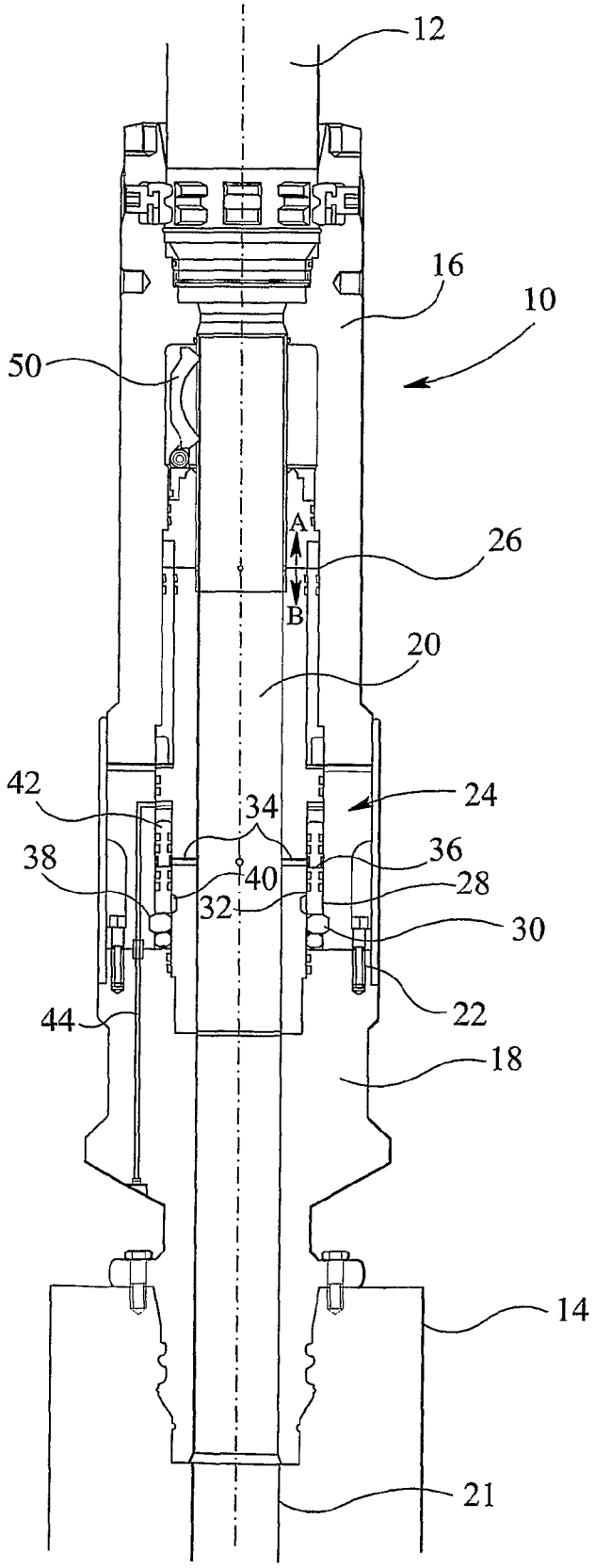
FIG. 1, is a section view of a riser weak link according to an embodiment of the present invention.

Reference is firstly made to FIG. 1, a section view of a riser weak link, generally indicated by reference numeral 10, according to an embodiment of the present invention. The riser weak link 10 is shown in an operational condition connected to an upper riser section 12 and a lower riser section 14.

The riser weak link 10 comprises an upper housing 16, connected to the upper riser section 12 and a lower housing 18 connected to the lower riser section 14. The upper and lower housings 16,18 define a throughbore 20, connecting the upper riser section 12 to a production tube 21, thereby permitting access to a downhole formation (not shown) by a service vessel (not shown) at the top of the upper riser section 12.

The upper and lower housings 16,18 are releasably connected by studs 22. The studs 22 are adapted to fracture at a predetermined force permitting the upper and lower housings 16, 18 to separate.

The production tube 21, the riser weak link 10 and the upper riser section 12, in use, are all exposed to well pressure. The well pressure acts on both the upper and lower housings 16, 18 at a housing interface 26. At this interface 26, the well pressure acts in the direction of arrow A to push the upper housing 16 upwards and in the direction of arrow B to push the lower housing 18 downwards. This separation force is in addition to a further separation force applied by the surface vessel (not shown) to the upper riser section 12 and upper housing 16 to keep the upper riser section 12 in tension.

In a conventional weak link, the connection devices (represented by studs 22 in the present invention) have to be rated to withstand both the separation force applied by well pressure and the separation force applied by the surface vessel. However, correctly rating the connection devices is difficult to achieve because well pressure can be variable and the rating chosen does not always lead to optimal operation of a conventional weak link.

To overcome this limitation the weak link 10 of the present invention incorporates a pressure application device 24. The pressure application device 24 is adapted to apply a coupling force to the upper housing 16 to counter the separation force applied, in use, by well pressure. The pressure application device comprises a pressure balance piston 28 and a latching device 30. The pressure balance piston 28 is an annular piston which encircles the outer surface 32 of a portion of the lower housing 18. The latching device 30 is a segmented band which also encircles the lower housing outer surface portion 32. The lower housing 18 defines a series of ports 34 which permits the well pressure to access and act on an upper surface 36 of the pressure balance piston 28. The area of the pressure balance piston upper surface 36 is chosen such that the downward force applied by the well pressure results in a coupling force equal to the separation force applied at the housing interface 26 in the direction of arrow A. As the well pressure coupling force is equal to the well pressure separation force, the only separation force experienced by the studs 22, is the tension applied to the upper riser section 12 by the surface vessel. As a result the studs 22 can be accurately rated to fracture at a tension less than the ultimate tensile strength of the riser but close enough to the ultimate tensile strength of the upper riser section 12 to maximise the utility of the upper riser section 12.

As can be seen from FIG. 1, the upper housing 16 defines an upper housing recess 38 which the latching device 30 engages in the position shown in FIG. 1. The lower housing 18 also defines a recess 40, the purpose of which will be described in due course.

The riser weak link 10 also comprises an override piston 42, which is used to apply a coupling force through the pressure activation device 24 to retain the upper and lower housings 16,18 in engagement when, for example, the riser weak link 10 is being run-into position. A downward force can be applied to the override piston 42 by the use of a hydraulic fluid pumped from a source (not shown) to a hydraulic line 44.

The riser weak link 10 further comprises a flapper 50 the purpose of which will be discussed in due course.

Figure 2:
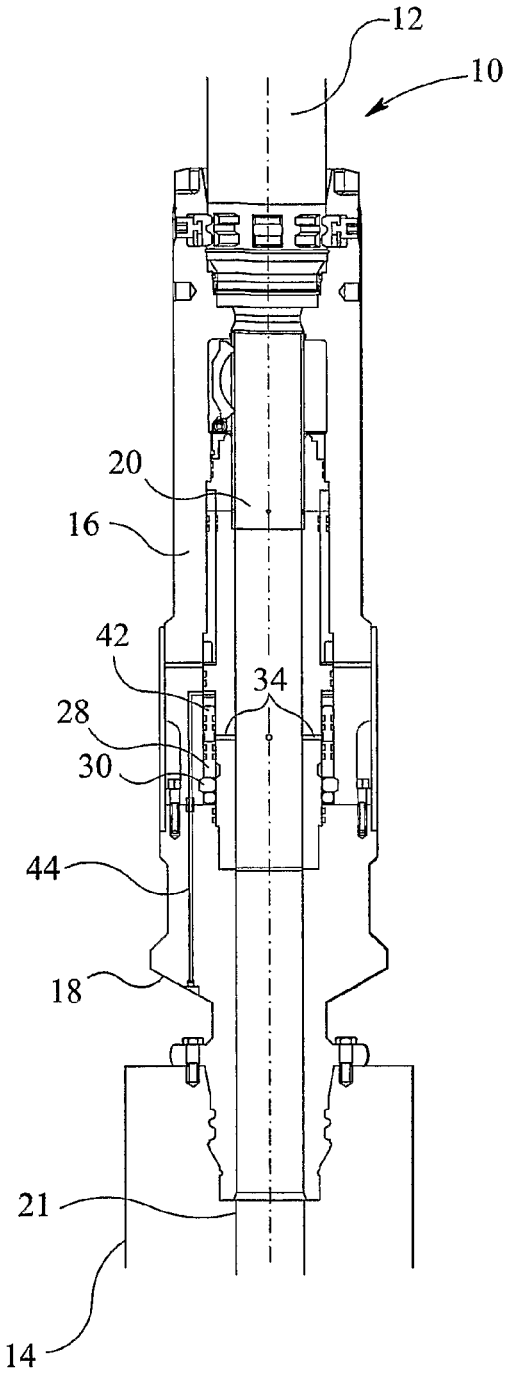
FIGS. 2-8 are a series of section views through the riser weak link of FIG. 1 showing the deployment (FIG. 2), operation (FIG. 3), separation (FIGS. 4-6), and recovery (FIGS. 7 and 8) of the riser weak link.

The operation of the riser weak link 10, will now be described with reference to FIGS. 2-8, a series of section views of the riser weak link. In FIG. 2, the riser weak link 10 has been brought in to engagement and secured to the lower riser section 14 but not yet exposed to well pressure. In this position, pressure is applied to the hydraulic line 44 from a source of hydraulic pressure (not shown) to the override piston 42. The hydraulic pressure is in turn passed through the pressure balance piston 28 and the latching device 30 to the upper housing 16 to force the upper housing 16 into engagement with the lower housing 18 and resist any separation force applied by the upper riser section 12.

Figure 3:
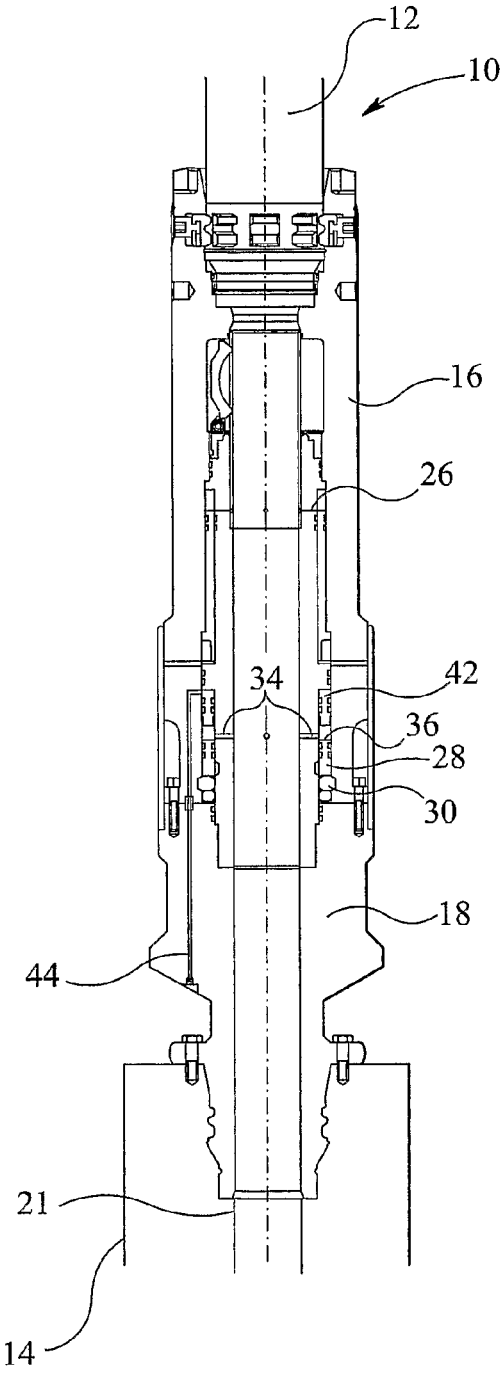

In FIG. 3, the normal operating condition of the riser weak link 10 is shown. In this position, the hydraulic pressure applied through hydraulic line 44 is removed consequently generating a compressive loading between the upper housing 16 and the lower housing 18. The well pressure acts through the lower housing ports 34 to move the override piston 42 upwards and apply the coupling force to the upper surface 36 of the pressure balance piston 28. The pressure balance piston 28 and latching device 30, in turn, transfer this coupling force to the upper housing 16 via the upper housing recess 38 to negate the effects of the separation force acting at the interface 26 of the upper and lower housings 16,18.

Figure 4:
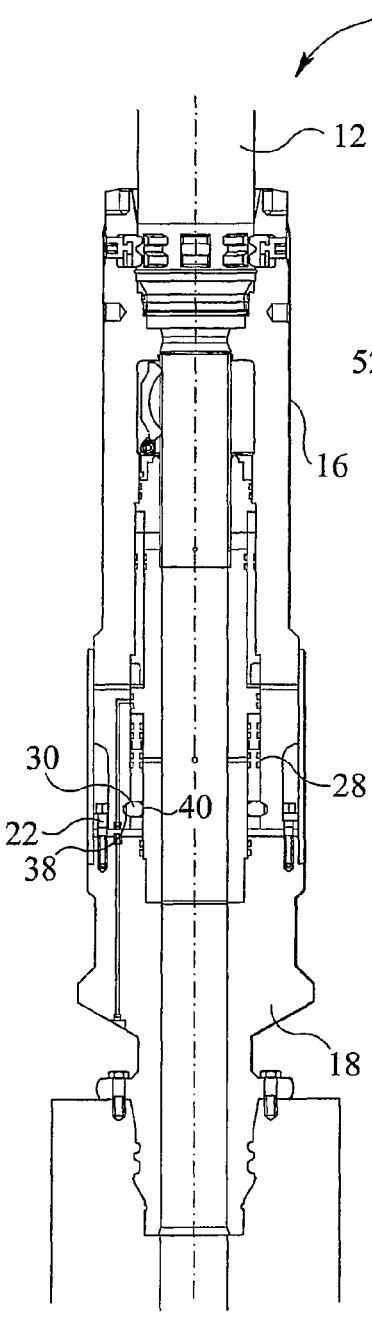

Referring now to FIG. 4, a situation is shown in which the tension in the upper riser section 12 has exceeded the rating of the studs 22, causing the studs 22 to fracture. With the studs 22 fractured, the upper housing 16 is lifted away from the lower housing 18 by the upper riser section 12, moving the pressure balance piston 28 and the latching device 30 to a second position, shown in FIG. 4. In this position, the latching device 30 can enter the lower housing recess 40 and disengage from the upper housing recess 38, breaking the connection between the latching device 30 and the upper housing 16, permitting the upper housing 16 to pull away from the lower housing 18.

Figure 5:
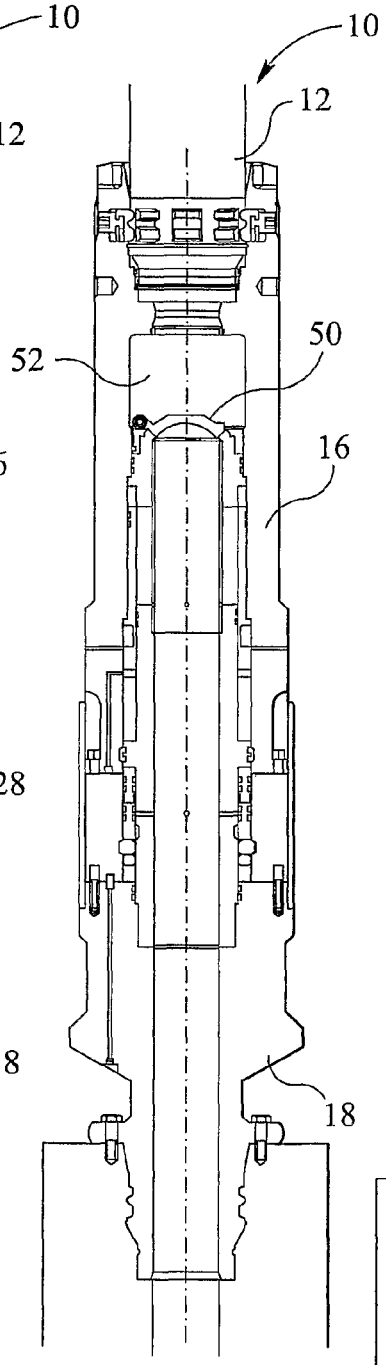

Referring now to FIG. 5, the upper housing 16, is pulled away further from the lower housing 18 and the flapper 50 has closed an upper housing throughbore 52, sealing the contents of the upper riser section 12 within the upper riser section 12, presenting a potential environmental catastrophe.

Figure 6:
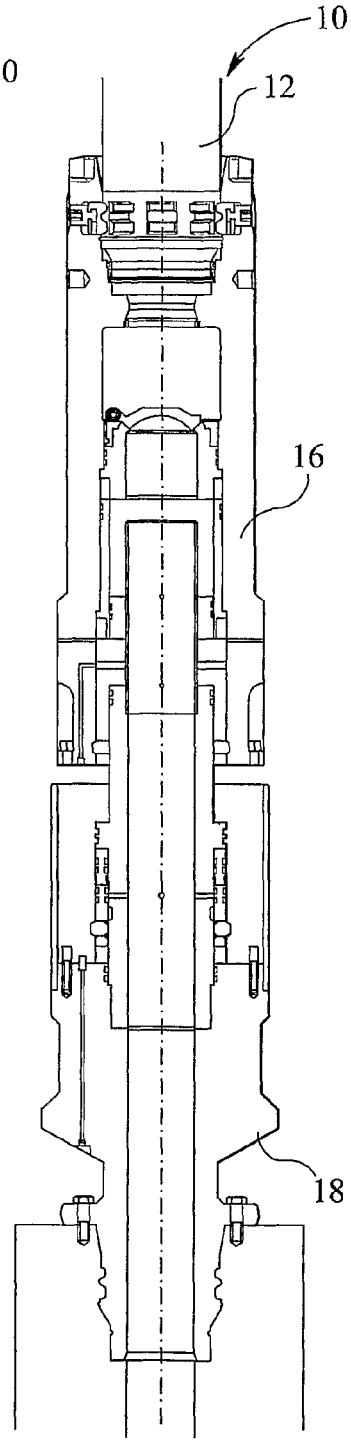

Referring now to FIG. 6, with the contents of the upper riser section 12 secure, the upper riser section 12 and the upper housing 16 can be pulled clear of the lower housing 18 and recovered to surface.

Figure 7:
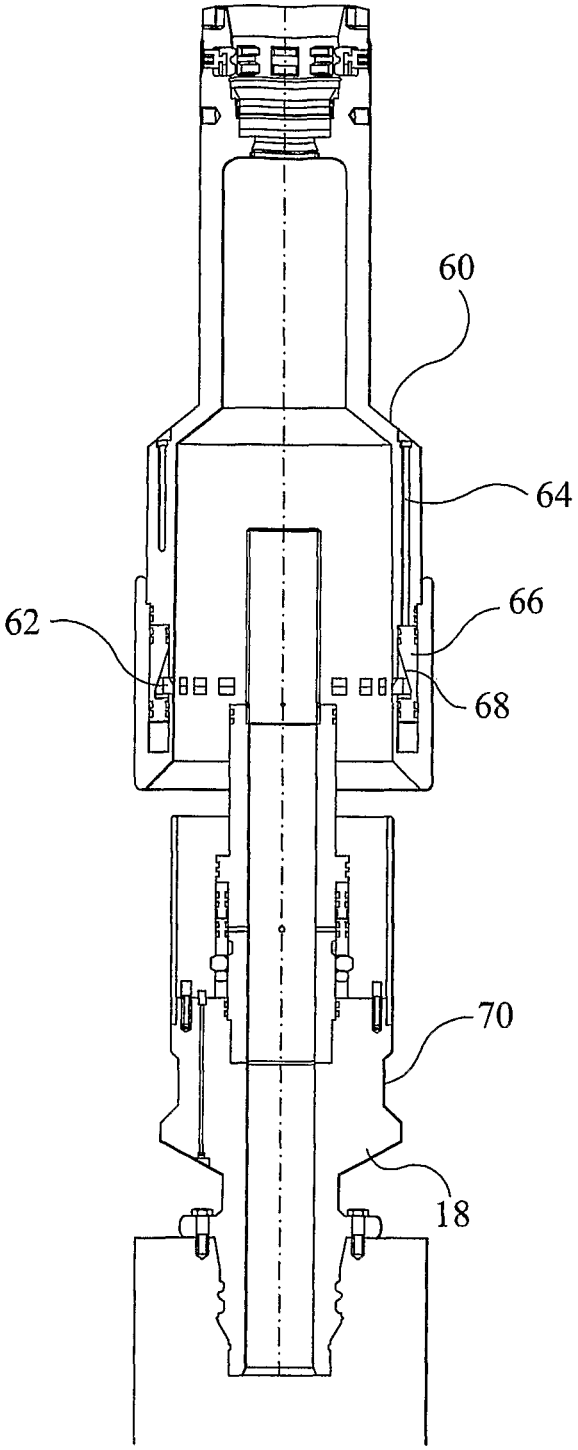
Figure 8:
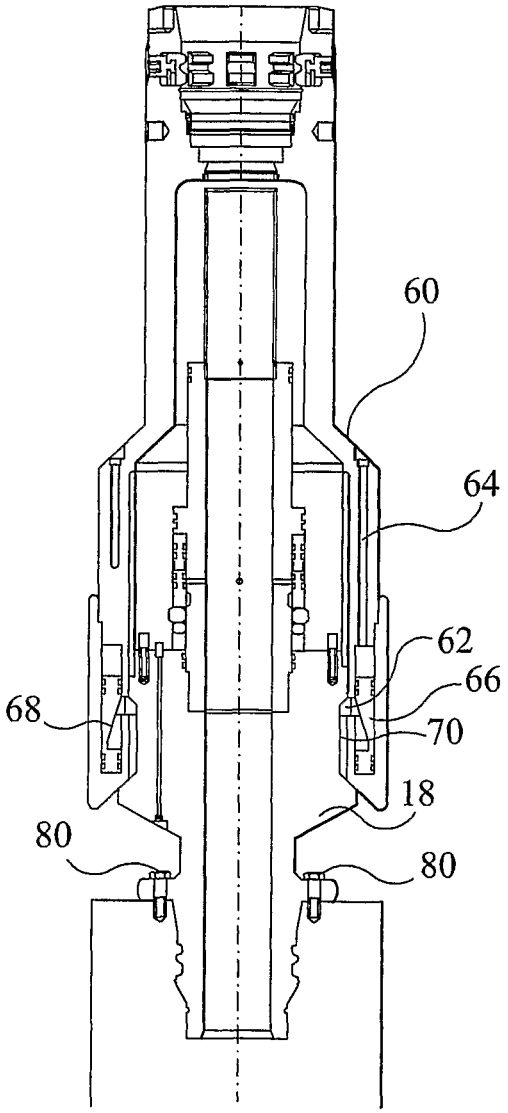

If it is desired to recover the lower housing 18 to surface, this can be achieved using a recovery tool as shown in FIGS. 7 and 8. As shown in FIGS. 7 and 8, a recovery tool 60 is lowered on to the lower housing 18. The recovery tool 60 comprises a series of dogs 62, which are moved from a run in configuration shown in FIG. 7 to a deployed configuration shown in FIG. 8 by the application of hydraulic pressure through a hydraulic line 64 to an annular setting cam 66. The setting cam 66, defines a cam surface 68 and movement of the setting cam 66 in an axial direction towards the lower housing 18 moves the dogs 62 from the run in configuration to the deployed configuration shown in FIG. 8. In the deployed configuration, the dogs engage a groove 70, defined by the lower housing 18. Once engaged in the groove 70, the lower housing 18 can be disconnected from the lower riser section 14 by disconnecting the attachment bolts 80 and the lower housing 18 can be recovered to surface.

Various modifications and improvements may be made to the above described embodiment without departing from the scope of the invention. For example although studs are shown connecting the upper and lower housings, any suitable connecting means may be employed such as mechanical latches, shear rings or hydraulic connectors.

The invention claimed is:

1. A riser weak link comprising:

an upper housing for connecting to a riser upper section, a lower housing for connecting to a riser lower section, at least one connection device for releasably connecting the upper and lower housings, and a pressure application device adapted to apply a coupling force to the upper housing to at least partially counter a separation force applied, in use, by well pressure, the well pressure separation force acting to separate the upper and lower housings such that the upper housing is adapted to disconnect completely from the lower housing, wherein the pressure application device comprises at least one pressure balance piston and at least one latch device, wherein the pressure application device is moveable between a first position in which the device is latched to the upper housing by action of the at least one pressure balance piston on the at least one latch device under the influence of the coupling force, and a second position in which the device is disengaged from the upper housing and the pressure application device is latched to the lower housing.

2. The riser weak link of claim 1, wherein the pressure application device utilises well pressure to apply the coupling force to the upper housing.

3. The riser weak link of claim 1, wherein the pressure application device is adapted to apply a counter force to the upper housing to fully counter the separation force applied, in use, by well pressure.

4. The riser weak link of claim 1, wherein the at least one connection device is adapted to permit the upper and lower housings to separate at a predetermined force.

5. The riser weak link of claim 1, wherein the at least one connection device is at least one stud.

6. The riser weak link of claim 5, wherein there are a plurality of studs.

7. The riser weak link of claim 6, wherein the studs are adapted to sever or fracture at a predetermined tension.

8. The riser weak link of claim 1, wherein the at least one connection device is at least one latch, shear ring, or hydraulic connector.

9. The riser weak link of claim 1, wherein the/each latch device, in the first position, is adapted to engage a latch recess defined by the upper housing.

10. The riser weak link of claim 1, wherein the/each pressure balance piston acts in a downward direction on the/each latch device which in turn transfers the coupling force to the upper housing.

11. The riser weak link of claim 1, wherein the/each pressure balance piston is an annular piston.

12. The riser weak link of claim 1, wherein the/each latch device is a collette or segmented band.

13. The riser weak link of claim 1, wherein the/each latch device comprises one or more dogs.

14. The riser weak link of claim 1, wherein movement of the upper housing moves the pressure application device from the first position to the second position.

15. The riser weak link of claim 1, wherein the/each latch device, in the second position, is adapted to engage a latch recess defined by the lower housing.

16. The riser weak link of claim 1, wherein the/each pressure balance piston is adapted to encircle a portion of the lower housing.

17. The riser weak link of claim 1, wherein when the upper housing is completely disconnected from the lower housing, the/each pressure balance piston is associated with the lower housing.

18. The riser weak link of claim 1, wherein the lower housing defines at least one port for permitting well pressure to access the pressure application device.

19. The riser weak link of claim 18, wherein in the first position the/each port is opened and in the second position the/each port is sealed by the/each pressure balance piston.

20. The riser weak link of claim 1, wherein the upper housing includes a closure device.

21. The riser weak link of claim 20, wherein the closure device is a flapper.

22. The riser weak link of claim 21, wherein the flapper is biased to seal the throughbore.

23. The riser weak link of claim 1, wherein the riser weak link comprises an override mechanism.

24. The riser weak link of claim 23, wherein the override mechanism is adapted to retain the pressure application device in the first position.

25. The riser weak link of claim 23, wherein the override mechanism comprises an override piston.

26. The riser weak link of claim 25, wherein the override piston is an annular piston.

27. The riser weak link of claim 25, wherein the override piston is adapted to act directly on the pressure application device.

28. The riser weak link of claim 27, wherein the override piston is adapted to act directly on the at least one pressure balance piston.

29. The riser weak link of claim 23, wherein the override mechanism is hydraulically controlled.

30. The riser weak link of claim 1, wherein the pressure balance piston moves in a first direction to latch the latch device to the upper housing at the first position, the pressure balance piston moving in a second direction opposite the first direction to allow the latch device to unlatch from the upper housing and latch to the lower housing in the second position.

31. A method of pressure balancing a riser weak link, the method comprising the step of:

exposing a pressure application device to a well pressure, the pressure activation device converting the well pressure to a coupling force and applying the coupling force to a riser weak link upper housing, the upper housing being releasably connected to a riser weak link lower housing, the coupling force at least partially countering a separation force applied by well pressure, the well pressure separation force acting to separate the upper and lower housings, wherein the coupling force acts on the pressure application device, the pressure application device being moveable between a first position in which the device is latched to the upper housing by action of at least one pressure balance piston on at least one latch device under the influence of the coupling force, and a second position in which the device is disengaged from the upper housing and the pressure application device is latched to the lower housing.

* * * * *